US010260297B2

(12) United States Patent
Mathieson et al.

(10) Patent No.: US 10,260,297 B2
(45) Date of Patent: Apr. 16, 2019

(54) SUBSEA WELL SYSTEMS AND METHODS FOR CONTROLLING FLUID FROM THE WELLBORE TO THE SURFACE

(71) Applicants: Derek Mathieson, The Woodlands, TX (US); Colin Bickersteth, Bisley (GB)

(72) Inventors: Derek Mathieson, The Woodlands, TX (US); Colin Bickersteth, Bisley (GB)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 14/872,753

(22) Filed: Oct. 1, 2015

(65) Prior Publication Data

US 2016/0097248 A1 Apr. 7, 2016

Related U.S. Application Data

(60) Provisional application No. 62/059,026, filed on Oct. 2, 2014.

(51) Int. Cl.

| | |
|---|---|
| ***E21B 21/08*** | (2006.01) |
| ***E21B 33/035*** | (2006.01) |
| ***E21B 33/064*** | (2006.01) |
| ***E21B 21/00*** | (2006.01) |

(52) U.S. Cl.

CPC ..... *E21B 21/08* (2013.01); *E21B 21/001* (2013.01); *E21B 33/0355* (2013.01); *E21B 33/064* (2013.01)

(58) Field of Classification Search

CPC .... E21B 21/08; E21B 21/001; E21B 33/0355; E21B 33/064

USPC ..... 166/363

See application file for complete search history.

(56) References Cited

U.S. PATENT DOCUMENTS

| | | | | |
|---|---|---|---|---|
| 4,313,496 | A * | 2/1982 | Childs | B23D 15/14 166/55 |
| 8,517,111 | B2 | 8/2013 | Mix et al. | |
| 8,528,660 | B2 | 9/2013 | Santos | |
| 2011/0232914 | A1 | 9/2011 | Reitsma et al. | |
| 2012/0227978 | A1 | 9/2012 | Fossli et al. | |
| 2012/0234550 | A1 | 9/2012 | Dietz et al. | |

FOREIGN PATENT DOCUMENTS

| | | | |
|---|---|---|---|
| WO | 2014046651 | A1 | 3/2014 |

OTHER PUBLICATIONS

PCT International Search Report and Written Opinion; International Application No. PCT/US2015/053474; International Filing Date: Oct. 1, 2015; dated Dec. 1, 2015; pp. 1-13.

* cited by examiner

*Primary Examiner* — Matthew R Buck
*Assistant Examiner* — Patrick F Lambe
(74) *Attorney, Agent, or Firm* — Cantor Colburn LLP

(57) ABSTRACT

A subsea wellbore system is disclosed in which a return fluid flows from a wellbore to the surface via an annulus between a drill string and a casing and then between the drill string and a riser, wherein the system includes a device configured to prevent flow of the return fluid flowing through the annulus between the drill string and the riser, and a bypass line configured to divert the flow of the return fluid from the annulus between the drill string and the riser to the surface.

19 Claims, 3 Drawing Sheets

SUBSEA WELL SYSTEMS AND METHODS FOR CONTROLLING FLUID FROM THE WELLBORE TO THE SURFACE

CROSS-REFERENCE TO RELATED APPLICATIONS

This application takes priority from U.S. Provisional Application Ser. No. 62/059,026, filed on Oct. 2, 2014, which is incorporated herein in its entirety by reference.

BACKGROUND

1. Field of the Disclosure

This disclosure relates generally to subsea well systems for controlling fluid flow there through in response to adverse downhole conditions, including formation fluid influx into the wellbore, commonly referenced to as a kick.

2. Background of the Art

Wellbores or wells are drilled in subsurface formations for the production of hydrocarbons (oil and gas). Subsea wells can extend more than 5,000 ft. below more than 10,000 ft. of water. Wellhead equipment, including blowout preventers (BOPs), kill line, and control modules are utilized at the sea floor for controlling pressure of the fluid in a return annulus between a drill string and a riser ("riser annulus") or to close the fluid flow through the wellbore (referred to as well shut-in) to prevent blowouts due to influx of fluid from the formation into the annulus between the drill string and the wellbore ("well annulus") due to higher pressure in the formation than in the wellbore. Such increase in the fluid flow returning from the wellbore to the surface is referred to herein as a "kick."

Operating companies involved in drilling of deep water wellbores have been experiencing a substantial increase in non-productive rig time (NPT). This is in part due to the uncertainty in the status or function of the subsea BOPs during drilling operations. The majority of this NPT is due to the additional rig time required to retrieve, check, and reinstall the BOP. Also on certain occasions, kicks are either not detected in a timely manner or the control units are not timely activated due to heavy dependence on human interaction at the surface. The first can result in shutting in the well (or killing the well) prematurely and the second in a blowout.

During drilling of a subsea wellbore, a fluid (mixture of water and certain additives) referred to as the "mud" is supplied to the wellbore via a drill string used for drilling the wellbore. The mud returns to the surface via an annulus between the drill string and the wellbore to a point above the BOP and then via an annulus between a riser and the drill string to the surface. The operators attempt to maintain pressure in the wellbore (referred to as the "hydrostatic pressure") above the pressure inside the formation surrounding the wellbore (referred to as the "formation pressure") by controlling the weight of the mud column in the wellbore so that the fluid from the formation will not enter into the wellbore, thereby avoiding kicks. In practice, on occasions, the formation pressure does exceed the hydrostatic pressure, causing kicks to occur. If the flow of the fluid due to a kick is successfully controlled, the kick is considered killed. An uncontrolled kick that results in the well unloading mud through the riser is referred to as a "blowout."

Kicks occur for a variety of reasons that include: (1) insufficient mud weight that exerts less pressure on the formation than the formation pressure; (2) improper hole fill-up during trips e.g. as the drill pipe is pulled out of the hole, the mud level falls but is not filled timely; (3) swabbing i.e. pulling the drill string from the borehole creates a swab pressure (negative pressure) that reduces the effective hydrostatic pressure below the formation pressure; (4) gas-contaminated mud which usually occurs when a fluid from a core being drilled releases gas into the mud, which expands and reduces the hydrostatic pressure; and (5) lost circulation which decreases the hydrostatic pressure due to a shorter mud column.

In the current subsea well systems, a kick is detected from several indicators, some of which are observed at the surface. Each rig crew member typically has the responsibility to recognize and interpret such indicators and take appropriate action. All such indicators, do not positively identify a kick, some merely warn of a potential kick situations. Key warning signs drilling personnel monitor include: (1) flow rate increase, while pumping mud at a constant rate which is interpreted as an influx of the formation fluid; (ii) mud pit volume increase at the rig site; (iii) flow rate measurement proximate to the BOP; (iv) flow of the mud into the mud pit when the surface pumps are shut down; (v) decrease in pump pressure and pump stroke increase due to fluid entering into the borehole that causes the mud to flocculate, causing temporary increase in the pump pressure; (vi) improper hole fill-up when the drill string is pulled out of the hole; and (vii) change in the drill string weight due to low buoyant effect on the drill string when gas enters the wellbore. Such methods involve interpretation of a large amount of data from a control system showing the parameters monitored during drilling. Such systems operate on the principle of containing a kick by closing a combination of BOP rams after interpreting the available data, then using the choke and kill lines to remove the kick. While such systems work in most cases, such systems may not provide timely detection and/or successful closure of the BOP rams around the casing or the drill string. In addition, using a riser for the return fluid can be ineffective because it requires closing and sealing the riser annulus in response to kicks, which in some cases does not occur. Therefore, it is desirable to provide a subsea wellbore system and methods that detect the presence of adverse conditions, such as kicks, in a timely manner, from an integrated set of sensors in addition to human input to take actions in real time or near real time in response to such detection to control the wellhead equipment to alleviate such adverse conditions.

Additionally, it is desirable to provide an alternative system and methods that do not rely on sealing the riser annulus in response to kicks.

The disclosure herein provides a relatively rapid response control system and a system for controlling return fluid flow outside the return path around the drill pipe for more effective control of the pressures due to kicks.

SUMMARY

In one aspect, a subsea wellbore system is disclosed in which a return fluid flows from a wellbore to surface via an annulus between a drill string and a riser above a BOP casing, wherein the system ("riser annulus"), a flow control device configured to close the annulus to prevent flow of the return fluid through the riser annulus, a bypass line configured to divert the flow of the return fluid below the BOP from the annulus to the surface, and a device in the bypass line configured to close the flow of the fluid through the bypass line.

In another embodiment, the subsea system includes a subsea wellhead that includes a ram for closing flow of a fluid from a wellbore to the surface, a first sensor that provides measurements relating to position of the ram, a second sensor that provides measurements relating to a kick in the wellbore, and a subsea control unit that determines presence of a kick in the wellbore from the measurements from the second sensor and controls the position of the ram in response to the determined presence of the kick.

In another aspect, a method of controlling flow of a fluid from a wellbore to the surface during drilling of a wellbore is disclosed wherein the fluid returning from the wellbore flows to the surface through an annulus between a drill string and a riser ("riser annulus"), above a BOP wherein the method includes: preventing or substantially preventing flow of the fluid through the riser annulus during drilling of the wellbore; and flowing the fluid returning from the wellbore to the surface through a bypass line from below the BOP.

Examples of the more important features of apparatus and methods have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
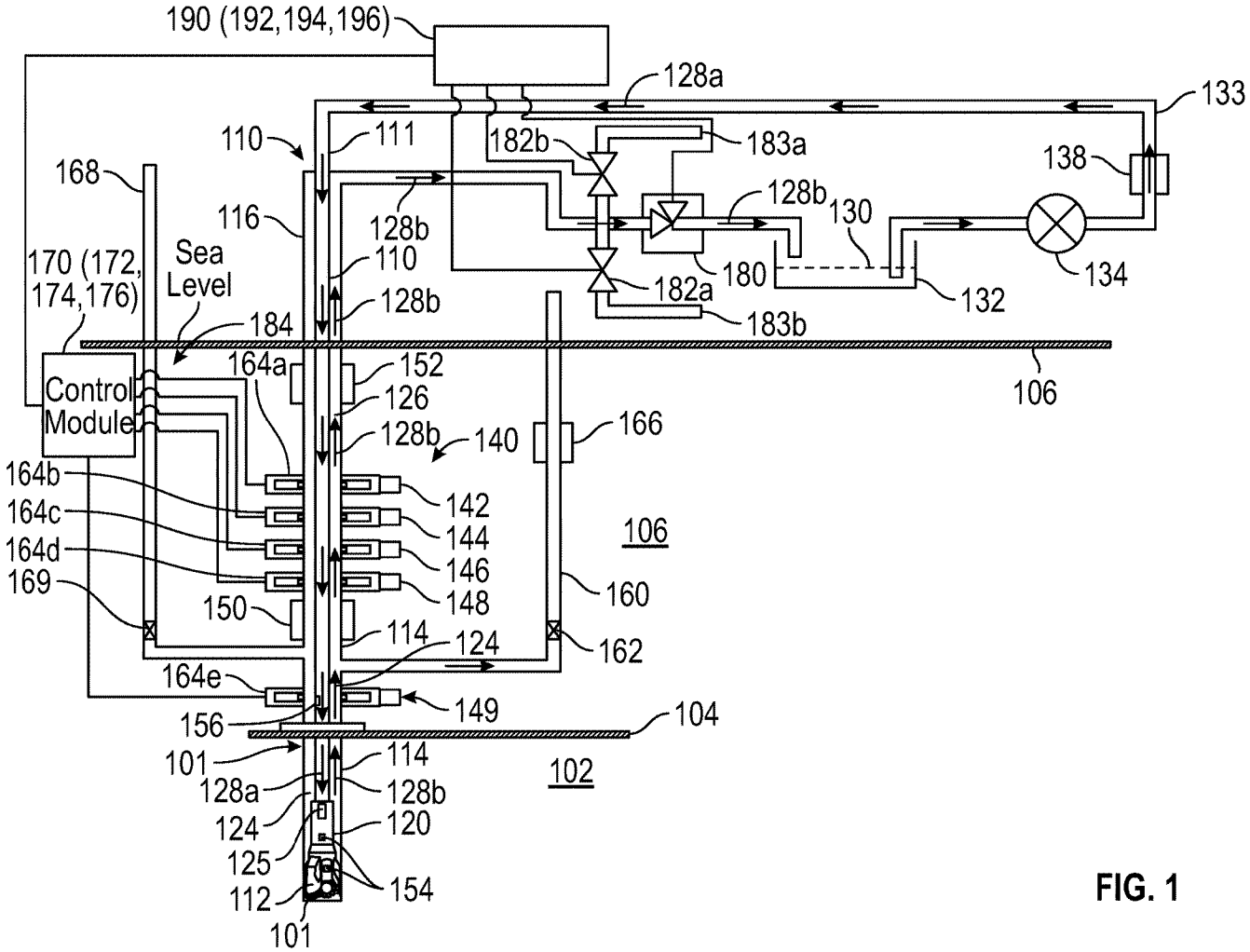
FIG. 1 is a schematic diagram of a subsea well system for controlling fluid flow through a wellbore in response to, determination of a fluid influx or kick and other conditions.

FIG. 1 is a schematic diagram of a subsea wellhead system 100 for controlling fluid flow from a wellbore upon detection of fluid influx or kick. A kick is defined herein as an increase in pressure or flow in the fluid returning from the wellbore to a surface location. A kick typically occurs due to a fluid, such as gas, oil, and/or water, entering into the wellbore from a formation surrounding the wellbore. The system 100 is shown to include a wellbore 101 being drilled into a formation 102 starting from a mud line 104 under water 106. A drill string 110 is shown deployed in the wellbore 101 for drilling the wellbore 101. The drill string 110 includes a drill pipe 111 that has a drilling assembly or bottomhole assembly (BHA) 120 connected at its bottom end thereof. A drill bit 112 at the end of BHA 120 is rotated to disintegrate the rock in the formation 102 to form the wellbore 101. To drill the wellbore 101, a casing 114 is installed in a section below the mud line 104 to stabilize the rock in the formation 102. A blow out preventor (BOP) stack 140 is placed on the well head 101*a*. A riser 116 is connected from the BOP stack 140 to a surface rig (not shown). The drill string 110 is conveyed into the wellbore 101 through the riser 116. A fluid 130, generally referred to as "mud," from a mud pit 132 is supplied under pressure by pumps 134 into the drill pipe 111. The drill bit 112 is rotated by rotating the drill string 110 and/or a mud motor (not shown) in the BHA 120 to disintegrate the formation rock. The fluid 130 flows as shown by arrows 128*a* from the pump 134 to the drill bit bottom. The disintegrated rock and the fluid discharged at the bottom of the wellbore 101 returns to the surface first via an annulus 124 between the wellbore 101 and the drill pipe 111 and then via an annulus 126 between the drill pipe 111 and the riser 116, as shown by arrows 128*b*.

In the system 100, the BOP stack 140 may be any stack utilized for subsea wellhead control. A typical BOP stack, such as stack 140, may include a blind shear ram 142 to cut the casing 114 and the drill pipe 111 above the wellhead 101, a casing shear ram 144 for cutting the casing 114 and pipe rams 146 and 148. The blind shear ram 142 is intended to seal the wellbore even when the drill string 110 is in the wellbore 101 by cutting through the drill pipe 111 as the ram closes off the wellbore 101. The casing shear ram 144 is generally positioned below the blind shear ram 142 and it forms a pressure seal over the wellbore 101. The pipe rams 146 and 148 form a seal around the drill pipe 111. A test ram 149 also is provided to test BOP ram operations, as is known in the art. The system 100 further includes a choke line 160 for circulating out a kick from the wellbore 101 when valve 162 is open. In addition, a kill line 168 and a choke 169 are provided to supply a fluid of a desired density to the well annulus 124 to suppress or kill the wellbore 101. In addition, the system 100 includes surface equipment, such as choke 180 and safe emergency dump points 183*a* and 183*b* after valves 182*a* and 182*b* respectively to control fluid flow at the surface.

The system 100 is further shown to include a network of sensors that may include, but are not limited to, an annular sensor 150 below pipe ram 148 for determining parameters of interest, including, but not limited to pressure, flow rate and temperature of the return fluid below the ram 148 and sensors 152 for determining such parameters above the BOP stack 140. Sensors 154 placed in the BHA 120 and/or in the drill bit 112 (measurement-while-drilling or MWD sensors) provide information relating to a variety of parameters, including an influx of a fluid (kick). Such sensors may include, but are not limited to, pressure sensors, flow rate sensors, temperature sensors, vibration sensors and any combination thereof. Additionally or alternatively, sensors 156 may be provided in the drill pipe 111 for detecting a kick. In some cases, it is difficult to detect kicks proximate to the drill bit 112 and it may thus be desirable to detect such kicks a certain distance above the drill bit 112, such as from sensors 156. Logging-while-drilling (LWD) sensors 125 in the BHA 120 may provide information about formation parameters, such as pore pressure, resistivity, rock structure, etc. In another non-limiting embodiment, sensors are provided to determine operations of the rams, such as the position of the rams for controlling the operations of the rams and to ensure proper cutting and/or sealing by the rams, as the case may be. Any suitable sensor may be utilized to determine the position of the arms in the rams, including, but not limited to, hall-effect sensors and linear motion or measurement sensors. Pressure sensors may also be utilized to determine the pressure applied by a ram for determining the closing of and/or sealing by the ram. In system 100 sensors 164*a* are associated with ram 142, sensors 164*b* with ram 144, sensors 164*c* with ram 146, sensors 164*d* with ram 148 and sensors 160*e* with ram 149. Sensors 166 are provided to determine the pressure, flow rate and/or temperature in the choke line 160. Sensors 138 in the fluid line 133 may include flow rate sensors, pressure sensors to determine the flow and pressure of the fluid 128*a* supplied to the drill string.

Still referring to FIG. 1, the system 100 further includes a subsea control module 170, which in one non-limiting embodiment, includes a processor 172, such as a microprocessor, a storage device 174, such as a solid-state memory, and instructions or programs 176 for the processor 172 to control operations of the various rams in a closed-loop manner in response to signals received from the various sensors described above and/or in response to signals received from a surface controller 190. The surface controller 190 may be a computer-based system that includes a processor 192, storage device 194 and programmed instructions 196. The controllers 170 and 190 communicate with each other via a suitable telemetry system available in the art. The controller 170 receives input from the ram sensors 164*a*-164*e*, downhole sensors 154 and 156, sensors 150 and 152 relating to the fluid 130, sensors 166 in the choke line 160 and determines therefrom the condition in the wellbore 101, including the presence of a kick, conditions of the rams 142, 144, 146, 148 and 149, the flow and pressure in the choke line 160 and the position of the choke valve 162. The control unit 170, in response to one or more determined conditions controls the operations of one or more subsea devices. In one aspect, the control unit 170 may transmit a condition to the surface controller 190 to cause the surface controller or an operator to take a particular action. For example, the control unit 170 may send a signal to the surface controller 190 to cause the surface controller or an operator to slow or stop pumping the mud 128*a* and close the rams 146 and/or 148. In another aspect, the control unit 170 may activate ram 142 and/or ram 144 to shut in the well. Controller 170 may transmit signals to the surface controller 190 or another receiver by any suitable telemetry mechanism, including, but not limited to, acoustic signals through the circulating fluid 128*a* and a link (for example, a wire or fiber optic line) in the riser 116.

The controller 170 and the network of sensors described in reference to FIG. 1 provide a fast loop response or control system for performing a variety of functions, including but not limited to: (i) providing real-time status information about various wellhead equipment, including status of each ram; (ii) real-time or near-real time control of the various equipment when a kick or another condition is detected. In another aspect, the controller 170 provides information to the surface that enables the surface controller 190 or an operator to take actions, such as controlling the supply of the fluid, activating a ram via hydraulic lines and/or supplying higher density fluid via a valve 169 and kill line 168. Such surface actions provide a slower response loop compared to the fast response loop when the controller 170 activates the various wellhead equipment upon determination of a condition. In yet another aspect, the controller 170 may provide information to the surface controller 190 to control the surface equipment, including, but not limited to, the mud pump 134, rotation speed of the drill string 110 and the wellhead equipment. Lines or links 184 provide connections between the controller 170 and the various sensors and devices. The lines 184, for example, may include electrical or fiber optic lines for receiving information from the various sensors and hydraulic and/or electrical lines for controlling the various rams, chokes, valves, etc. Link 185 provides communication between controllers 170 and 190.

Figure 2:
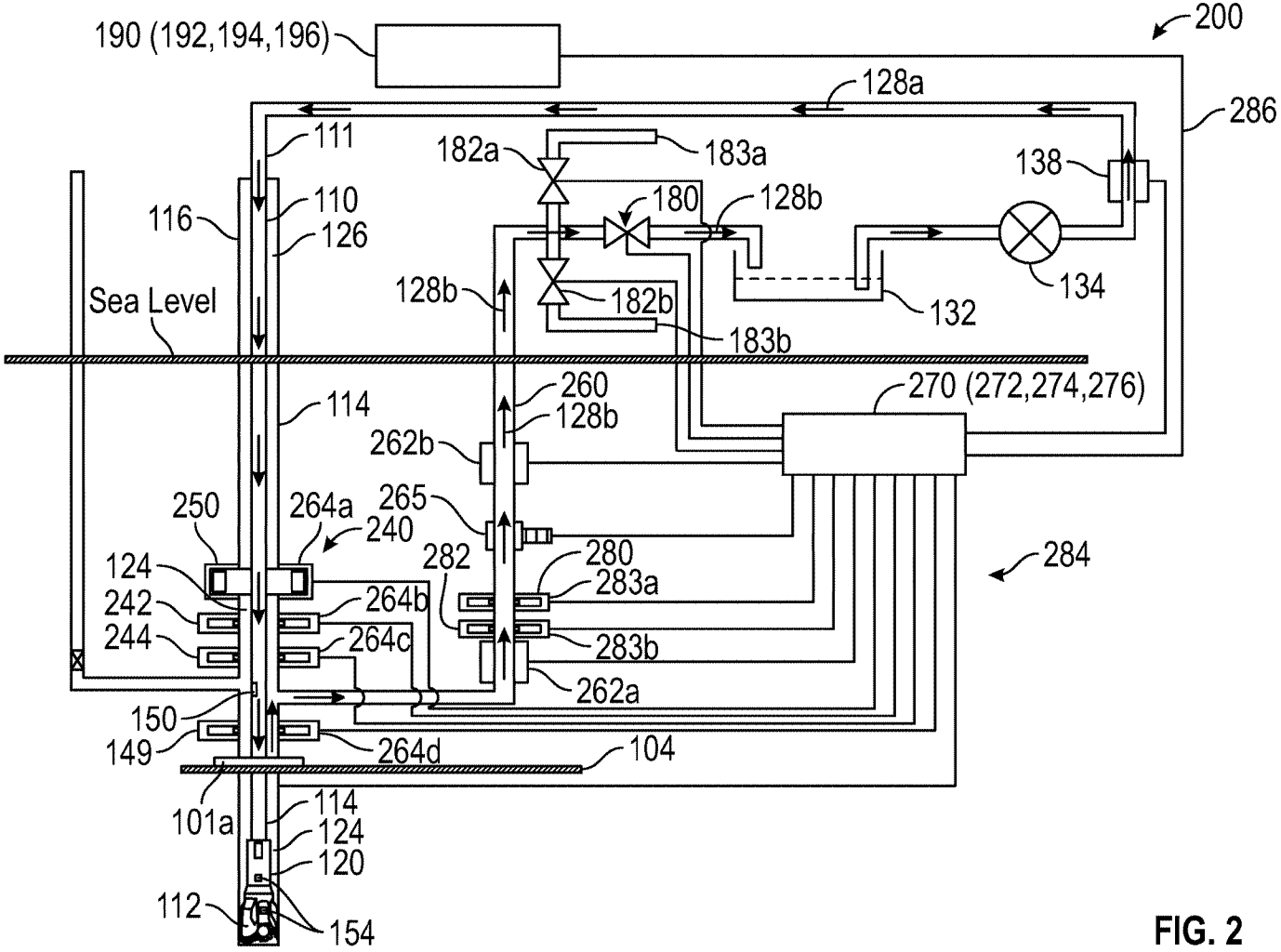
FIG. 2 is a schematic diagram of a subsea well system that utilizes a bypass line from below a BOP for flowing return fluid from the wellbore to the surface and for controlling, fluid flow from the wellbore to the surface and other parameters.

FIG. 2 is a schematic diagram of a subsea system 200 for controlling fluid from the wellbore 101 utilizing a bypass or secondary line 260 for circulating return fluid to the surface during drilling of the wellbore 101. In system 200, the surface equipment includes a controller 190 (192, 194, 196), mud pump 134, valves 180, 182*a* and 182*b*, dump points 183*a* and 183*b* and sensors 138 as described in reference to system 100 of FIG. 1. In one embodiment, the bypass line may replace the choke line 160 shown in FIG. 1. The system 200 also includes a BOP stack 240 that includes a test ram 149, a blind shear ram 242 to cut the casing 114 and the drill pipe 111 and a casing shear ram 244, which perform the same functions as rams 142 and 144 described in reference to FIG. 1. The system 200 further includes an annulus closure device 250 to close the riser annulus 126 between the drill string 110 and the casing 114 above the BOP stack 240. The bypass line 260 is configured to flow the return fluid 128*b* from the wellbore 101 to the surface, bypassing riser annulus 124 above the BOP stack 240 during drilling operations by closing the riser annulus 126 by the annular closure device 250. The system 200 further includes one or more rams 280 and 282 configured to close the bypass line 260. Thus, during drilling, when the riser annulus 124 is closed, the return fluid 128*a* flows through the bypass line 260 instead of through the riser annulus 126. When the bypass line 260 is closed by rams 280 and/or 282, the well is shut in. In addition, a choke 265 is provided in the bypass line 260 to control the back pressure in the wellbore 101, when the bypass line 260 is open.

Still referring to FIG. 2, the system 200 includes a number or network of sensors. In one aspect, MWD sensors 154 in the BHA 120 and/or the drill bit 112 provide information relating to downhole parameters, such as pressure, temperature, flow rate and vibration. LWD sensors 125 provide information about formation parameters, such as pore pressure, resistivity, rock structure, etc. Sensors 150 provide information about parameters in the riser annulus 124 (pressure, flow rate, temperature, etc.) below the BOP stack 240, while sensors 262*a* and 262*b* provide similar information about the fluid flowing in the bypass line 260 below and above bypass the rams 280, 282 respectively. Sensors 264*a* provide information about the position of the annulus closure device 250, sensors 264*b*, 264*c* and 264*d* respectively provide position information and information about other suitable parameters of the rams 242, 244 and 149, while sensors 283*a* and 283*b* respectively provide similar information relating to rams 280 and 282 in the bypass line 260. Additionally, pressure sensors may be utilized to determine pressure applied by the rams 242, 244, 149, 280 and 282 on their corresponding pipes. A subsea control unit 270 that includes a processor 272, a storage device 274 and instructions 276 for the processor is configured to control the operation of the subsea wellhead devices, including the annulus closure device 250, rams 242, 244, 149, 280 and 282, and choke 265. Lines 284 provide connections between the controller 270 and the various sensors and devices. The lines 284, for example, may include electrical or fiber optic lines for receiving information from the various sensors and hydraulic and/or electrical lines for controlling the various rams, chokes, valves, etc. The data from the sensors 125 and 156 may be communicated to the surface controller 190 and/or the subsea controller 270 by any known telemetry system, including mud-pulse telemetry system and wired pipe. Line 286 provides a link between controllers 270 and 190.

In one aspect, during drilling the annulus closure device 250 is activated by the controller 270 and/or controller 190 or by an operator at the surface to prevent the flow of the return fluid 128*b* through the riser annulus 126, while the rams, 242 and 244 in casing 114 and rams 280 and 282 in the bypass line 260 are inactive or deactivated. Since the riser annulus 126 above the BOP stack 240 is closed, the return fluid 128*b* flows to the surface via the bypass line 260 as shown by arrows 128*b*. If a kick is detected, the controller 270 and/or controller 190 may activate rams 242 and 242 in sequence with rams 280 and/or 282 to shut in the wellbore 101. Controller 270 also may communicate the kick detection or any other condition to the surface to cause the controller 190 or an operator to take an action, such as choking flow by operating choke 265 or stopping drill string 110 rotation, shutting down or slowing down pumps 134, activating rams 242 and/or 244 and 280 and 282. As described in reference to system 100 of FIG. 1, the controller 270 also may receive information from LWD sensors 125 and MWD sensors 154 from the BHA and drill bit and combine such information with information from other sensors to take actions described herein. Thus, in aspects, in the system 200, the subsea controller 270 may provide an automated fast control of the flow of the fluid from the wellbore and various wellhead equipment in response to a detected or determined condition and/or communicate with the surface controller 190 that in turn alone or in combination with controller 270 may control the flow of the fluid from the wellbore and the operation of various devices in the system 200.

Thus, in system 200, rather than flowing mud 128*b* all the way to the surface through the riser annulus 126, the bypass line 260 is used as the main conduit for mud flow to the surface. Sensors, such as sensors 262*a* and 262*b*, are incorporated into the bypass line 260 for the control of the return fluid 128*b* to the surface and prevent kicks. The bypass 260 line also may be used as a choke line. An advantage of the system 200 is that valves close in an open bore rather than in an annulus and thus no longer are required to seal around the drill pipe 111. A choke 265 controls the pressure and flow of the return fluid up to the point the system may be overloaded and requires shut in of the wellbore. Choke 265 controls the pressure and flow of the return fluid up to the point the system may be overloaded and requires shut in of the wellbore. Sensing or detecting adverse conditions can occur before and after the valves and choke in the bypass line 260. The sensors 262*a* before the valves and choke may include multiple sensors reading a parameter, such as pressure, with a voting system e.g. if 3 out of 4 sensors detect a pressure spike, the controller 270 closes the ram 280 and/or 282 in sequence with rams 242 and 244, thereby providing a relatively fast or real time or near real lime system for closing wellhead equipment. In other aspects, sensors may be hooked in with the other sensors shown in system 200 to provide alarms and to control the choke line valves as well as provide an automated "last chance" or "dead man" control. The sensors 262*a* and 262*b* downstream and upstream of the valves and choke in the bypass line may be used to control the position of the choke 265. The bypass line 260 runs to the mud pit 132 or to a safe expulsion point at the surface, where emergency valves close off the bypass line and allow venting of the overload in line 260.

Figure 3:
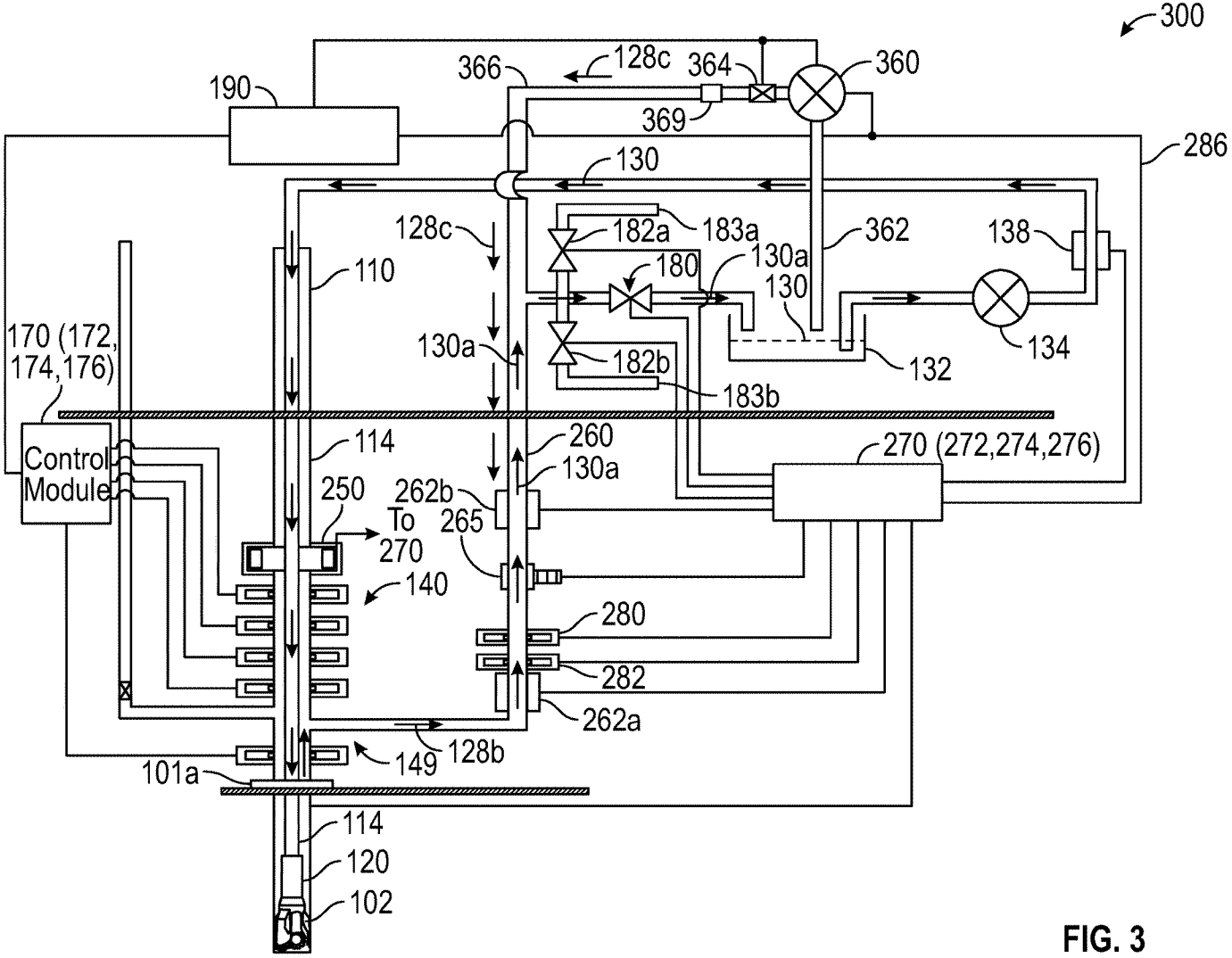
FIG. 3 is a schematic diagram of a subsea well system that includes various features of systems of FIGS. 1 and 2 and a unit or system to manage pressure in the well bore.

FIG. 3 is a schematic diagram of a subsea wellbore system 300 that integrates the various features of the system 100 of FIG. 1 and system 200 of FIG. 2 In some embodiments, system 300 may also include a system for managing back pressure in the bypass line, as described in more detail later. In system 300, the surface equipment is essentially the same as shown in FIGS. 1 and 2. It includes a surface controller 190, pumps 134, valves 180, 182*a* and 182*b* and sensors 138. The system 300 further includes a BOP stack 140, controllers 170 and 190, valve 267, and a controller 270 as shown in FIG. 2. In addition, system 300 includes the annulus flow control device 250 above the BOP stack 140, as shown in FIG. 2. A bypass line 260 is provided to bypass fluid 128*b* from below the BOP stack 140 to the surface 280 and 282 control the flow of the fluid 128*a* through the bypass line 260. In one configuration, controller 170 receives information from the various sensors in system 300 and in response to one or more parameters determined from such information and/or information received from the surface controller 190 controls the operations of the rams in the BOP stack 140. A bypass line controller 270 control the operation of the choke 265, rams 280 and 282 in the bypass line 260. In one non-limiting embodiment, controller 270 receives information from sensors 262*a*, 262*b* and other sensors and determines a parameter of interest, such as the presence of a kick, and controls the operations of the BOP stack rams 140 in sequence with rams 280, 282 and choke 265 in the bypass line 260. In another embodiment, the functions of the controllers 170 and 270 may be combined into a common control unit (not shown). Controllers 170 and 270 communicate with the surface controller 190 and may be configured to communicate with each other directly.

Still referring to FIG. 3, the system 300, in some embodiments, may include a system for managing back pressure in the bypass line 260 in case of a kick or any other reason. In one non-limiting embodiment, the back pressure managing system may include a pump 360 that supplies fluid 128*c* from mud tank 132 to the bypass line 260 in the direction opposite from the flow of return fluid 128*b* shown in FIG. 2. Pump 360 may receive fluid 128*c* from mud tank 132 via a conduit 362 and supply fluid 128*c* to bypass line 260 via a valve 364 and conduit 366. Pump 360 and valve 364 may be controlled by surface controller 190 and/or choke controller 270 in response to one or more parameters relating to the operation of the system 300, including detection of a kick.

During drilling of the wellbore 101, the annulus flow control device 250 is closed while choke 265 is open or partially open. The fluid 128*b* from the wellbore 101 returns to the surface via the bypass line 260. If a kick is detected, controller 170 alone or cooperating with controller 270 and/or controller 190 may control the operations of the rams in the BOP stack 140, while controller 270 alone or in cooperation with controllers 170 and/or 190 may control the operations of the rams 280 and 282 to shut in the wellbore 101. To manage back pressure in the bypass line 260, when mud pump 134 is stopped and valve 180 is closed, preventing fluid 128*b* from returning to the mud tank 132. Pump 360 is started and valve 364 opened, which supplies fluid 128*c* from the mud tank 132 to the bypass line 260. Controllers 190 and/or 270 control the operation of the pump 360 to maintain the hydrostatic pressure in wellbore above the formation pressure. The wellbore pressure management unit or system that includes pump 360 and associated components may be utilized with the system shown in FIG. 2 or excluded from the system shown in FIG. 3. Thus in the system of FIG. 3, a first device, such as flow control device 152, may be configured to prevent flow of the return fluid through the annulus between the drill string and the riser; a bypass line configured to divert the flow of the return fluid to the surface bypassing the annulus between the drill string and the riser, and second device, such as valve 180 may be provided to close the flow of the return fluid through the bypass line. A third device, such as flow control device 262*b* may be utilized to control or restrict the flow of the return fluid through the return line. Controllers and sensors are utilized to control the various operations of the system.

The foregoing disclosure is directed to the certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including, but not limited to." Also, the abstract is not to be used to limit the scope of the claims.

The invention claimed is:

1. A subsea wellbore system wherein a return fluid flows from a wellbore to a surface via an annulus between a drill string and a casing and then an annulus between the drill string and a riser, the system comprising:

an annular closure device along the riser above a blow-out preventer stack, the annular closure device configured to close the annulus between the drill string and the riser during drilling of the wellbore;

a bypass line connecting the annulus below the blow-out preventer stack to the surface, wherein the bypass line diverts the return fluid from the closed annulus below the blow-out preventer stack to the surface during drilling of the wellbore;

a ram along the bypass line configured to be in an inactive state when the annular closure device closes the annulus and configured to activate to close the flow of the return fluid through the bypass line in response to a kick occurring while the annular closure device is closed; and a pump in the bypass line configured to pump fluid from a mud tank into the bypass line to maintain a hydrostatic pressure in the wellbore above a formation pressure.

2. The system of claim 1 further comprising a flow control device configured to restrict flow of the return fluid through the bypass line.

3. The system of claim 1 further comprising a control unit configured to: (i) determine a parameter of interest from a sensor in the system; and (ii) control the ram and the flow control device in response to the determined parameter of interest.

4. The system of claim 3, wherein the parameter of interest is kick and wherein the sensor is located at one of: (i) in the bypass line below the ram; (ii) in the annulus below the annular closure device; (iii) in the wellbore; and (iv) in an assembly used for drilling the wellbore.

5. The system of claim 3 further comprising a flow control device for controlling back pressure in the wellbore when the return fluid is flowing through the bypass line.

6. The system of claim 1 further comprising a sensor for determining closure of the ram.

7. The system of claim 1 further comprising a sensor for providing information about position of the ram and a control unit that controls the position of the ram in response to detection of a kick in the wellbore.

8. The system of claim 1 further comprising a fluid supply unit that supplies a fluid into the bypass line against the fluid flow direction of the return fluid in the bypass line when the return fluid is temporarily stopped from flowing through the bypass line.

9. A subsea wellbore system, comprising:

a subsea wellhead including an annular closure device for closing an annulus of the wellbore during drilling of the wellbore;

a bypass line for returning fluid from below the annular closure device to a surface location;

a ram along the bypass line configured to be in an inactive state when the annular closure device closes the annulus and configured to shut in the bypass line in response to a kick occurring in the wellbore while the annular closure device is closed;

a first sensor for determining a position of the ram;

a second sensor for providing measurements relating to a kick in the wellbore;

a subsea control unit that determines presence of the kick in the wellbore occurring when the annular closure device is closed from the measurements from the second sensor and controls the position of the ram in response to the determined kick; and a pump in the bypass line configured to pump fluid from a mud tank into the bypass line to maintain a hydrostatic pressure in the wellbore above a formation pressure.

10. The system of claim 9, wherein the second sensor is placed at a location selected from a group consisting of: below the ram; in an assembly used for drilling the wellbore; and inside the wellbore.

11. The system of claim 9, wherein the subsea control unit transmits information to a surface controller about the presence of the kick and controls the ram in response to instructions received from the surface controller.

12. A method of controlling flow of a fluid from a subsea wellbore to surface during drilling of a wellbore wherein a fluid supplied from a surface location into a drill string returns from the wellbore to the surface via an annulus between the drill string and a casing and then an annulus between the drill string and a riser above a blow-out preventer, the method comprising:

activating an annular closure device above the blow-out preventer during drilling to close an annulus between the drill string and the riser, thereby preventing flow of the return fluid through the annulus; and flowing the return fluid to the surface via a bypass line connecting the annulus below the blow-out preventer to a surface location when the annular closure device is activated drilling of the wellbore;

activating a ram along the bypass line in response to a kick while the annular closure device is closed during drilling operations in order to close the bypass line to prevent flow of the return fluid through the bypass line; and activating a pump in the bypass line to pump fluid from a mud tank into the bypass line to maintain a hydrostatic pressure in the wellbore above a formation pressure.

13. The method of claim 12 further comprising closing the flow of the return fluid through the bypass line upon determining a parameter of interest.

14. The method of claim 13 further comprising closing the blow-out preventer along with the ram in the bypass line upon determining the parameter of interest to prevent flow of the return fluid beyond the blow-out preventer.

15. The method of claim 12, wherein determining the parameter of interest comprises using measurements from a sensor located at one of: in the bypass line; in a drilling assembly utilized for drilling the wellbore; and a location below the blow-out preventer.

16. The method of claim 12 further comprising determining flow of the fluid through the bypass line after closing the bypass line to determine effectiveness of the closure of the bypass line.

17. The method of claim 12 further comprising controlling flow of the return fluid through the bypass line to control back pressure in the wellbore when the bypass line is open.

18. The method of claim 12 further comprising confirming closing the ram utilizing signals from a position sensor in the ram.

19. The method of claim 12 further comprising:

stopping supply of the fluid from the surface into the drill string upon detection of a kick; and supplying a fluid from the surface into the bypass line in a direction opposite direction of the return fluid in the bypass line to manage pressure in wellbore.

* * * * *